United States Patent [19]

Frater et al.

[11] Patent Number: 4,521,151

[45] Date of Patent: Jun. 4, 1985

[54] CENTRIFUGAL SLURRY PUMP

[75] Inventors: John S. Frater, Carlisle; David W. Pope, Sevenoaks, both of United Kingdom

[73] Assignee: Joy Manufacturing Holdings Limited, England

[21] Appl. No.: 545,106

[22] PCT Filed: Apr. 4, 1981

[86] PCT No.: PCT/GB81/00035

§ 371 Date: Nov. 4, 1981

§ 102(e) Date: Nov. 4, 1981

[87] PCT Pub. No.: WO81/02613

PCT Pub. Date: Sep. 17, 1981

Related U.S. Application Data

[63] Continuation of Ser. No. 320,977, filed as PCT GB 81/00035, Mar. 4, 1981, published as WO 81/02613, Sep. 17, 1981, § 102(e) date Nov. 4, 1981, abandoned.

[30] Foreign Application Priority Data

Mar. 7, 1980 [GB] United Kingdom ..... 8007912

[51] Int. Cl.[3] ..... F04D 29/08

[52] U.S. Cl. ..... 415/131; 415/128; 415/170 B; 415/171; 415/196

[58] Field of Search ..... 415/131, 132, 128, 127, 415/196, 206, 219 C, 170 B, 170 A, 171

[56] References Cited

U.S. PATENT DOCUMENTS

| | | | |
|---|---|---|---|
| 327,370 | 9/1885 | Williams | 416/223 R |
| 1,404,717 | 1/1922 | Humphrey | 415/131 |
| 1,638,055 | 8/1927 | Nagle | 415/196 X |
| 1,672,216 | 6/1928 | Hollander | 415/DIG. 3 |
| 1,743,916 | 1/1930 | Hargis | 415/128 |
| 1,878,429 | 9/1932 | Staup | 415/128 |
| 1,878,429 | 9/1982 | Staup | 415/196 X |
| 1,891,267 | 12/1932 | Nilkowski | 415/171 |
| 2,862,453 | 12/1958 | Nagle | 415/170 A X |
| 3,101,671 | 8/1963 | Schroeder | 415/131 X |
| 3,130,679 | 4/1964 | Sence | 415/206 X |
| 3,162,135 | 12/1964 | Nichols et al. | 415/196 |
| 3,188,966 | 6/1965 | Tetlow | 415/128 |
| 3,324,800 | 6/1967 | Schroeder | 415/128 |
| 3,451,343 | 6/1969 | Kabele | 415/128 |
| 3,542,496 | 11/1970 | Bergeson et al. | 415/170 A X |
| 3,680,976 | 8/1972 | Buse | 415/219 C X |
| 3,711,218 | 1/1973 | Kennel et al. | 415/131 |
| 3,771,927 | 11/1973 | Schiller | 415/131 |
| 4,099,890 | 7/1978 | Murakami et al. | 415/170 A |
| 4,101,241 | 7/1978 | Kasuya | 415/170 A X |

FOREIGN PATENT DOCUMENTS

| | | | |
|---|---|---|---|
| 725507 | 9/1942 | Fed. Rep. of Germany | 415/196 |
| 2110776 | 9/1972 | Fed. Rep. of Germany | 416/186 A |
| 2719168 | 11/1978 | Fed. Rep. of Germany | 415/DIG. 3 |
| 105302 | 8/1979 | Japan | 416/131 |
| 285335 | 2/1928 | United Kingdom . | |
| 556853 | 10/1943 | United Kingdom | 415/DIG. 3 |
| 391287 | 1/1974 | U.S.S.R. | 415/171 |

*Primary Examiner*—Everett A. Powell, Jr.

[57] ABSTRACT

A pump, for example, a centrifugal slurry pump, has a casing (10) with an inlet (12) and an outlet (14). The casing (10) and a separate backliner (28) define a chamber (16) in which an impeller (18) is arranged to be rotated by way of a drive shaft (20) which extends axially with respect to the casing (10). Fine running clearances are defined between the front and rear surfaces of the impeller (18) and the adjacent surfaces of the casing (10) and the backliner (28). In order to compensate for increases of the running clearances, for example, due to erosion, the backliner (28) may be moved axially relative to the casing (10). The backliner (28) is connected to an annular flange (38) which is bolted to an annular flange (36) connected to the casing (10) and the spacing between the flanges (36, 38) may be adjusted by removing one or more shims (40) provided therebetween.

6 Claims, 3 Drawing Figures

CENTRIFUGAL SLURRY PUMP

This application is a continuation of application Ser. No. 320,977 filed as PCT GB 81/00035, Mar. 4, 1981, published as WO 81/02613, Sep. 17, 1981, § 102(e) date Nov. 4, 1981 now abandoned.

The present invention relates to pumps, especially to centrifugal slurry pumps.

A centrifugal pump has running clearances between the front and rear surfaces of the impeller and the corresponding surfaces of the casing. For good pump performance it is required that these running clearances be kept fine. However, slurry is abrasive and/or corrosive and wears the impeller and casing during operation such that the clearances, particularly the front clearance, increase. As the clearances increase more slurry and larger solid particles are enabled to pass between the impeller and the casing and this not only increases the rate of wear but also decreases the efficiency of the pump.

Some slurry pumps are provided with means for adjusting the axial position of the impeller within the casing such that the increase in the front running clearance can be compensated. However, adjustment of the impeller in this respect increases the back running clearance and reduces the effectiveness of the drive shaft sealing arrangement of the pump by putting this sealing arrangement under higher pressure. This adversely affects the overall performance of the pump. Furthermore, it has not heretofore been possible to provide for any adjustment of a submersible pump in which the impeller is directly coupled to an electric motor.

It is an object of the present invention to provide a pump in which increase in at least one of the running clearances can be compensated more effectively than previously.

According to the present invention there is provided a pump comprising a casing defining a chamber, an impeller arranged for rotation within the chamber about the axis of the chamber, and adjusting means for adjusting the axial dimension of the chamber.

As the axial dimension of the chamber is adjustable increases in the running clearances can be efficiently compensated.

Preferably, the chamber is defined between the casing and a backliner supported at the back of the casing. The adjusting means are arranged to enable axial movement of the backliner relative to the casing for adjusting the axial dimension of the chamber.

In an embodiment, the backliner is connected to a first annular flange which is coaxial with said casing. The casing carries a second annular flange arranged coaxially of said first flange. The flanges are axially spaced by a plurality of shims and bolted together to hold the backliner at the back of the casing. When the bolts are released, the number of shims between the two flanges can be altered to vary the axial spacing of the flanges and hence move the backliner axially with respect to the casing. The bolts are subsequently retightened with the flanges held at their adjusted spacing. Preferably, each shim is made up of two separate, substantially semi-circular parts, for ease of insertion and removal.

In an embodiment, further adjusting means are provided for adjusting the axial position of the impeller within the chamber. These further adjusting means enable the impeller to be correctly repositioned within the chamber when the axial dimension of the chamber has been adjusted.

In an embodiment, the impeller is carried on a rotatable drive shaft extending axially with respect to the casing, and said further adjusting means are arranged to enable axial movement of the drive shaft, and hence of the impeller, relative to the casing. Said further adjusting means may comprise any conventional mounting enabling axial adjustment of the drive shaft. For example, the drive shaft may be provided with a bearing cartridge fixed with respect to a frame housing, which supports the casing, by releasable clamping means. The clamping means can be loosened to allow axial movement of the bearing cartridge and the shaft and thereafter tightened to fix the shaft in the adjusted position.

In an embodiment, the impeller has a plurality of curved internal vanes extending from the eye of the impeller to its periphery. These vanes are also twisted at their end adjacent the eye of the impeller. It has been found that this increases the efficiency of the pump as it reduces turbulence and wear at the eye.

An embodiment of the present invention will hereinafter be described, by way of example, with reference to the accompanying drawings, in which.

Figure 1:
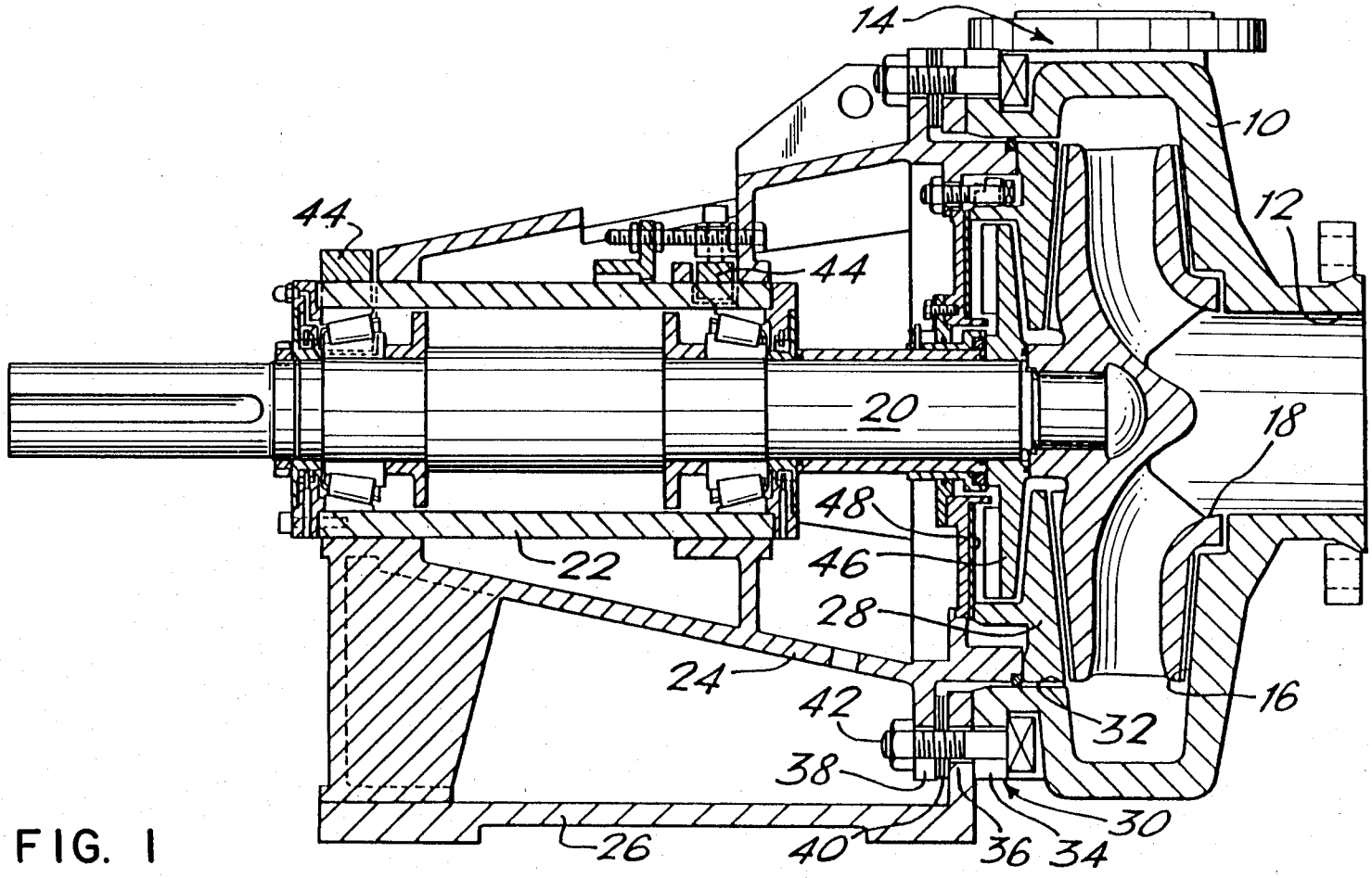
FIG. 1 shows an axial section of a centrifugal slurry pump of the invention.

FIG. 1 shows a pump comprising a volute shaped casing 10 having an inlet 12 and an outlet 14. An impeller 18 is arranged for rotation within the casing 10. The impeller 18 is rotationally fixed on a drive shaft 20 which extends axially of the casing 10. The drive shaft 20 is rotatably mounted in a bearing housing 22. The bearing housing 22 is supported by a frame housing 24 which is fixed to a base plate 26. Generally, the base plate 26 is bolted to the ground or to a structure.

In known manner, a chamber 16 is defined by the casing 10 and a separate annular backliner 28 which is fixed to the frame housing 24. Fine running clearances are defined between the front and rear surfaces of the impeller 18 and the adjacent surfaces of the casing 10 and the backliner 28.

At its rear, the casing 10 is provided with an annular projection 30 of substantially L-shaped cross-section defining a circumferential surface 32 which contacts the outer peripheral surface of the backliner 28. In addition, the annular projection 30 defines an annular flange 34 which abuts an annular flange 36 formed on the base plate 26. This annular flange 36 is spaced from a further annular flange 38 formed on the frame housing 24 by a plurality of shims 40. The flanges 34, 36 and 38 which are all coaxial with the casing 10, are connected together by a plurality of bolts 42. In this manner, the casing 10, backliner 28, frame housing 24 and base plate 26 are all rigidly connected.

Figure 2:
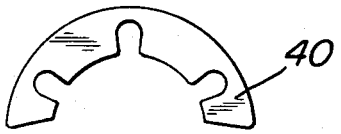
FIG. 2 shows a plan view of a spacing shim used in the pump.

The bolts 42 extend through slots (not shown) in the shims 40. Furthermore, each shim 40 is made up of two halves each having a circumferential extent which is less than that of the semi-circumference of the flanges 36 and 38, as shown in FIG. 2. Thus, not all the bolts 42 extend through the shim halves, and the shim halves can be removed or inserted between the flanges 36 and 38 simply by loosening the bolts 42.

The bearing housing 22 is fixed relative to the frame housing 24 by adjusting means including clamps 44 which can be released to enable axial movement of the bearing housing 22 relative to the frame housing 24. As such adjusting means are known they will not be further described herein.

The pump illustrated includes bearings for the drive shaft 20, and various stationary and dynamic seals all of which are conventional and are similarly not described further herein.

It will be appreciated that during operation, rotation of the impeller 18 delivers slurry from the inlet 12 to the outlet 14. Furthermore, the pressure of the slurry at the outlet 14 is higher than at the inlet 12. Accordingly, there is a tendency for a reverse flow of slurry through the fine running clearances to be established and this wears the casing, backliner, and impeller surfaces and increases the clearances leading to inefficiency of pump operation.

After the pump has been operating for some time adjustment to compensate for the wear should be made. The adjustment procedure will now be described.

Initially, the clamps 44 fixing the bearing housing 22 to the frame housing 24 are released such that the bearing housing 22, and hence the drive shaft 20, is movable axially relative to the frame housing 24. The drive shaft 20 is then displaced backwardly. The impeller 18 is thus moved axially in the chamber 16. The shaft 20 is manually rotated to determine when the impeller 18 contacts the backliner 28. The shaft 20 is then axially displaced forwardly by a predetermined amount to move the impeller 18 out of contact with the backliner 28 and leave the required fine running clearance between the back surface of the impeller 18 and the backliner 28. The bearing housing 22 is then clamped again to the frame housing 24 by the clamps 44.

As there has been wear of the impeller 18 and casing 10 it will be appreciated that at this stage there will be a large clearance between the front surface of the impeller 18 and the casing 10. This front clearance is then adjusted by means of the adjusting means comprising the shims 40.

The bolts 42 which pass through the shims 40 are loosened and the required number of shims 40 are then removed. The bolts 42 are then tightened. As the bolts 42 are tighthened the flanges 36 and 38 are drawn towards one another and thus the casing 10 and the backliner 28 move axially relative to one another, the outer peripheral surface of the backliner sliding on the circumferential surface 32 of the casing 10. Thus, the axial spacing between the front and rear surfaces of the chamber 16 is reduced by the total depth of the shims 40 removed. As the shims 40 preferably each have a depth of 1 mm the axial spacing of the chamber 16 can be accurately adjusted to compensate for the wear.

If required, after the front running clearance has been adjusted by removal of the necessary number of shims, the positioning of the impeller 18 within the chamber 16 can be finely adjusted by moving the drive shaft 20 axially as described above. In this way, it is also possible to comfirn that the correct number of shims has been removed.

As has been described above, the removal of one or more of the shims brings about a relative axial movement between the casing 10 and the backliner 28 such that the axial dimension of the chamber 16 is reduced. If this reduction corresponds to any increase in size occasioned by wear the running clearances will be restored to the optimum value and the efficiency of the pump will be maintained. The arrangement of shims illustrated is particularly convenient for allowing the relative axial displacement of the casing and backliner but other arrangements may, of course, be provided if required.

It will be appreciated that, depending upon the wear, the back hydrodynamic seal formed by an expeller 46 may be maintained in substantially the same position relative to the backliner 28 and the frame housing 24 even after adjustment. Accordingly, there will be no loss of efficiency of this back hydrodynamic seal. Furthermore, in some instances the adjustment reduces the running clearance between the vanes of the expeller 46 and its expeller plate 48. Accordingly, in this case there is an improvement in the efficiency of this back hydrodynamic seal.

The adjusting means comprising the clamps 44 enables axial displacement of the bearing housing 22 and hence of the drive shaft 20. Of course, any other arrangement enabling axial movement of the drive shaft 20 may be provided as required. The structure of these adjusting means will be chosen in accordance with the particular form of back bearing cartridge provided.

Figure 3:
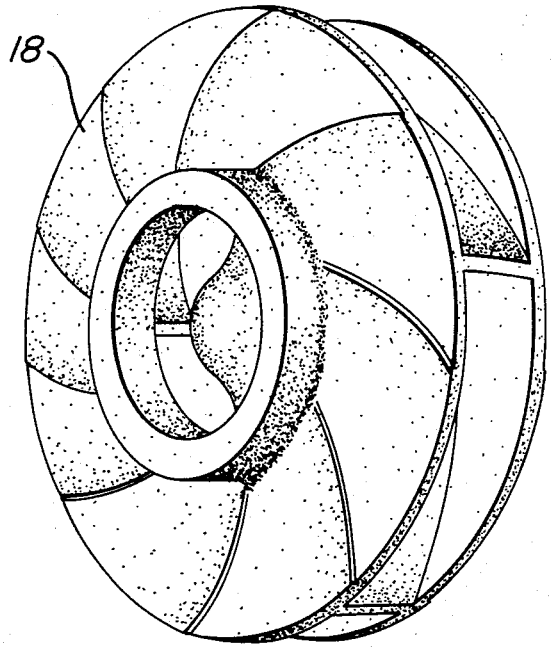
FIG. 3 shows a perspective view of the pump impeller.

The pump illustrated in the drawing has been designed for optimum efficiency. In particular, the internal vanes of the impeller 18 are not only curved from the eye of the impeller to its periphery but are also twisted at their end adjacent the eye towards the eye, as shown in FIG. 3.

It has been found that this increases the efficiency of the pump as it reduces turbulence and wear at the eye.

In an embodiment described above, the casing 10 is volute shaped. Of course, the casing may be circular or any other shape as required.

The present invention may be used with submersible or other pumps in which the impeller is directly coupled to an electric motor. It will be appreciated that as such pumps do not have a drive shaft provided with a back bearing cartridge it is not possible to provide conventional means for adjusting the axial position of the impeller. Accordingly, such pumps are not, at present, provided with any means to enable adjustment. However, such a pump can be provided with adjusting means as described above for adjusting the axial dimension of the chamber. Of course, if such adjusting means are provided alone, the position of the impeller within the chamber cannot be adjusted to take into account the change in the axial dimension of the chamber. However, as most wear occurs at the front of the chamber it can be effectively compensated by adjusting the axial dimension of the chamber and in many instances adjustment of the axial position of the impeller would not, in fact, be necessary. Indeed, if required, the slurry pump illustrated in the drawing could be provided only with the adjusting means including the shims 40.

We claim:

1. A pump, comprising: a unitary generally C-shaped casing in which an inlet and an outlet are defined, a backliner supported at a rear portion of the casing, a pump chamber defined by the casing and the backliner, a rear housing adjacent said backliner, said backliner being axially movable with a first flange member affixed to said rear housing and arranged coaxially with said casing, said casing including an integral second flange member arranged coaxially of said first flange member, said first and second flange members being releasably interconnected to said the backliner in position to establish the rear extent of said chamber, said first and second flange members being axially spaced by structure including removable shims interposed therebetween, an impeller disposed within the chamber and rotatable about an axis of the chamber, a rotatable drive shaft extending coaxially with said axis of the chamber, said impeller being carried by and fixed to said drive shaft for rotation and axial movement therewith, said impeller having a front surface and a back surface, and said impeller being disposed within the chamber such that a front running clearance is defined between a front surface of the impeller and a facing surface of the casing and a back running clearance is defined between a back surface of the impeller and a facing surface of the backliner, wherein said front surface extends over the entire radial extent of the impeller whereby said front running clearance extends over the entire radial extent of the impeller between said front surface and the corresponding facing surface of the casing, and wherein said back surface extends over the entire radial extent of the impeller and said backliner extends radially a distance equal to that of said back surface whereby said back running clearance extends over the entire radial extent of the impeller between the back surface and the corresponding facing surface of the backliner, the pump further comprising adjusting means for enabling axial movement of the shaft and impeller relative to the chamber, said shims and adjusting means enabling the axial extent of both said front and said back running clearances to be maintained at less than a predetermined maximum value, whereby increases in said running clearance due to wear and corrosion may be compensated for at the back surface of the impeller by movement of said shaft and impeller with respect to said backliner and at the front surface of said impeller by movement of the casing with respect to said backliner, rear housing and impeller so as to reduce the axial length and volume of the chamber.

2. A pump according to claim 1, wherein the first and second flange members are releasably connected by bolts extending through said flange members and through slots in said shims.

3. A pump according to claim 2, wherein the or each shim is made up of two separate, substantially semicircular parts.

4. A pump according to claim 3, wherein the casing is supported on a frame housing, and wherein the drive shaft is provided with a bearing cartridge (22) fixed with respect to the frame housing by releasable clamping means.

5. A pump according to claim 1, wherein the impeller has a plurality of curved internal vanes extending from the eye of the impeller to its periphery, and wherein the end of each vane adjacent the eye of the impeller is twisted towards the eye.

6. A pump according to one of claims 1, 4, 5, 4 or 5, further comprising an expeller carried by the drive shaft and arranged for rotation in an expeller chamber defined by the backliner and an expeller plate.

* * * * *